US010182597B2

(12) United States Patent
Schiff et al.

(10) Patent No.: US 10,182,597 B2
(45) Date of Patent: Jan. 22, 2019

(54) ELECTRONIC SMOKING ARTICLE

(71) Applicant: Altria Client Services LLC, Richmond, VA (US)

(72) Inventors: David Schiff, Highland Park, NJ (US); Chris Carrick, Newark, DE (US); Eric Hawes, Midlothian, VA (US); Ali A. Rostami, Glen Allen, VA (US); Christopher S. Tucker, Midlothian, VA (US); Berina Yerkic-Husejnovic, Richmond, VA (US)

(73) Assignee: ALTRIA CLIENT SERVICES LLC, Richmond, VA (US)

( * ) Notice: Subject to any disclaimer, the term of this patent is extended or adjusted under 35 U.S.C. 154(b) by 676 days.

(21) Appl. No.: 14/497,401

(22) Filed: Sep. 26, 2014

(65) Prior Publication Data

US 2015/0083147 A1 Mar. 26, 2015

Related U.S. Application Data

(60) Provisional application No. 61/883,023, filed on Sep. 26, 2013.

(51) Int. Cl.
*A24F 47/00* (2006.01)

(52) U.S. Cl.
CPC ..... *A24F 47/008* (2013.01)

(58) Field of Classification Search
CPC .... A24F 47/008; A24F 47/002; A24F 47/004; A61M 15/06; H05B 1/025; H05B 3/06; H05B 3/24; H05B 3/66; H05B 7/10; H05B 7/101
USPC ..... 131/329
See application file for complete search history.

(56) References Cited

U.S. PATENT DOCUMENTS

| | | | |
|---|---|---|---|
| 4,947,875 | A | 8/1990 | Brooks et al. |
| 2011/0304282 | A1 | 12/2011 | Li et al. |
| 2013/0192621 | A1 | 8/2013 | Li et al. |
| 2013/0199528 | A1 | 8/2013 | Goodman et al. |
| 2013/0220315 | A1 | 8/2013 | Conley et al. |

(Continued)

FOREIGN PATENT DOCUMENTS

| | | |
|---|---|---|
| CN | 1040914 | 4/1990 |
| CN | 101268867 A | 9/2008 |

(Continued)

OTHER PUBLICATIONS

International Search Report and Written Opinion dated Dec. 17, 2014.

(Continued)

*Primary Examiner* — Joseph S Del Sole
*Assistant Examiner* — Mohamed K Ahmed Ali
(74) *Attorney, Agent, or Firm* — Harness, Dickey & Pierce, P.L.C.

(57) ABSTRACT

An electronic smoking article includes a liquid aerosol formulation, at least one filamentary wick operable to transfer the liquid aerosol formulation, at least one heater operable to at least partially volatilize the liquid aerosol formulation and form an aerosol, a power supply operable to apply voltage across the at least one heater, and a support plate operable to support the at least one heater and the filamentary wick and to form an electrical connection between the at least one heater and the power supply.

14 Claims, 3 Drawing Sheets

(56) References Cited

U.S. PATENT DOCUMENTS

| | | | | |
|---|---|---|---|---|
| 2014/0000638 | A1* | 1/2014 | Sebastian | A24F 47/008 131/328 |
| 2014/0209105 | A1* | 7/2014 | Sears | F22B 1/28 131/328 |
| 2014/0270729 | A1* | 9/2014 | DePiano | A24F 47/008 392/397 |
| 2015/0157055 | A1* | 6/2015 | Lord | A24F 47/008 131/329 |
| 2016/0157523 | A1* | 6/2016 | Liu | A24F 47/008 392/395 |

FOREIGN PATENT DOCUMENTS

| | | | |
|---|---|---|---|
| CN | 102753047 | A | 10/2012 |
| CN | 104219973 | A | 12/2014 |
| EA | 019736 | | 5/2014 |
| EP | 2340730 | A1 | 7/2011 |

OTHER PUBLICATIONS

International Preliminary Report on Patentability for Corresponding PCT application No. PCT/US2014/057613, dated Apr. 7, 2016.
Eurasian Office Action dated Sep. 20, 2017 for Eurasian Application No. 201690653.
Eurasian Office Action dated Mar. 1, 2018 in Eurasian Application No. 201690653.
Chinese Office Action dated Mar. 2, 2018 in related Chinese Application No. 201480053478.9, with an English translation.

* cited by examiner

ELECTRONIC SMOKING ARTICLE

CROSS REFERENCE TO RELATED APPLICATION

This application claims priority under 35 U.S.C. § 119(e) to U.S. provisional Application No. 61/883,023, filed on Sep. 26, 2013, the entire content of which is incorporated herein by reference thereto.

WORKING ENVIRONMENT

Many of the embodiments disclosed herein include electronic smoking articles operable to deliver liquid from a liquid supply reservoir (source) to a heater. The heater volatilizes a liquid to form an aerosol.

SUMMARY OF SELECTED FEATURES

An electronic smoking article comprises a liquid aerosol formulation, at least one filamentary wick operable to transfer the liquid aerosol formulation, at least one heater operable to at least partially volatilize the liquid aerosol formulation and form an aerosol, a power supply operable to apply voltage across the at least one heater, and a support plate operable to support the at least one heater and the filamentary wick and to form an electrical connection between the at least one heater and the power supply.

The support plate includes a conductive circuit printed thereon. The support plate also includes at least two pins extending from the conductive circuit of the support plate. Each of the at least two pins is connected to opposing (spaced apart) portions of the at least one heater.

In an embodiment, the electronic smoking article further comprises a reservoir including an outer wall and having an oval cross-section. Moreover, the electronic smoking article can include a mouth end insert.

Preferably, the at least one heater is a coil heater in communication with the at least one filamentary wick. In one embodiment, the at least one filamentary wick comprises a first wick and a second wick. The first wick includes a first end extending into the reservoir and a second end in contact with the second wick. In this embodiment, the at least one filamentary wick has a generally T-shape. In another embodiment, the at least one filamentary wick comprises a single wick having a generally U-shape. The filamentary wick includes opposing ends each extending into the reservoir. The heater is wrapped about a central portion of the filamentary wick.

In one embodiment, the at least one heater is upstream of the reservoir. In an alternative embodiment, the at least one heater is downstream of the reservoir.

An electronic smoking article comprises a heater element, a power source, a housing, and a support plate at a fixed location along said housing. The support plate includes first and second pins extending between first and second locations of the support plate to spaced apart locations along the heater, respectively, and connections at third and fourth locations of the support plate for establishing electrical connections between the plate and the power source, the third and fourth locations spaced from the first and second locations, the connections including first and second printed circuit elements electrically connecting the first and third locations and the second and third locations, respectively. The pins support and electrically connect the heater with the power source.

DETAILED DESCRIPTION

An electronic smoking article includes a liquid supply (reservoir or housing or source), the contents of which consist essentially of a wick and a liquid aerosol formulation.

As used herein, the term "electronic smoking article" is inclusive of all types of electronic smoking articles, regardless of form, size or shape, including electronic cigarettes, electronic cigars, electronic pipes, electronic hookahs and the like. The liquid aerosol formulation can include nicotine or be nicotine free. Moreover, the liquid aerosol formulation can include tobacco flavors or instead, or in combination include other suitable flavors.

The housing is otherwise essentially free of a fibrous material therein. The liquid aerosol formulation is delivered from the reservoir via the filamentary wick associated with a heater. The heater heats the liquid aerosol formulation and volatilizes it to form an aerosol. The reservoir is contained between a first gasket and a second gasket. The electronic cigarette also includes a support plate adjacent the first gasket or the second gasket. The support plate is operable to support the heater and the wick and facilitate connection of electrical leads to the heater.

Figure 1:
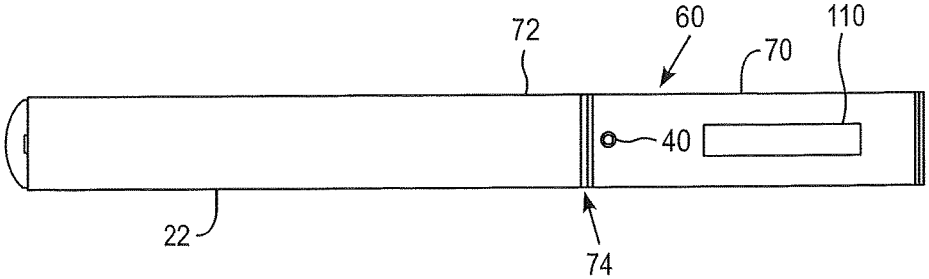
FIG. 1 is a side view of an electronic smoking article constructed according to the teachings herein.
Figure 2:
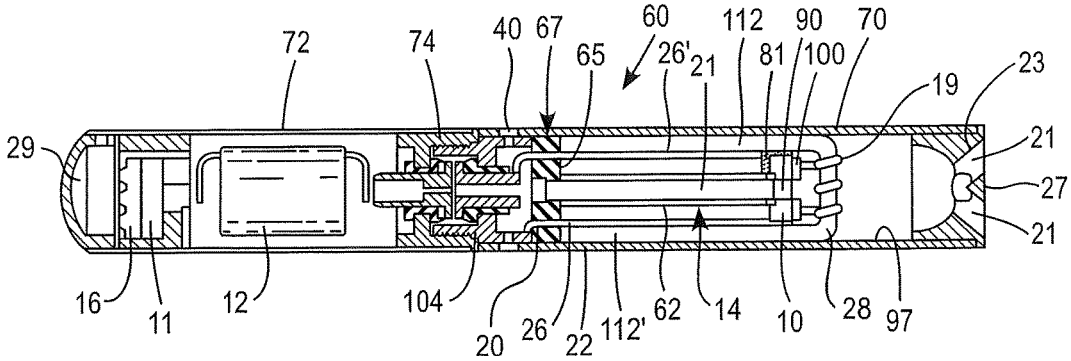
FIG. 2 is a cross-sectional view of an electronic smoking article according to a first embodiment.

Preferably, as shown in FIGS. 1 and 2, the electronic smoking article 60 comprises a replaceable cartridge (or first section) 70 and a reusable fixture (or second section) 72, which are coupled together at a threaded joint 74 or by other convenience such as a snug-fit, snap-fit, detent, clamp and/or clasp. The first section 70 houses a mouth-end insert 27, a heater 19, a flexible filamentary wick 28 and a reservoir 14. The second section 72 houses a power supply 12, such as a battery, control circuitry 11, and optionally a puff sensor 16. The threaded portion 74 of the second section 72 can be connected to a battery charger when not connected to the first section 70 for use so as to charge the battery.

Preferably, the first section 70 and the second section 72 include an outer cylindrical housing (casing) 22 extending in a longitudinal direction along the length of the electronic smoking article 60. In another embodiment, the outer housing 22 may comprise a single, unitary tube, without any threaded connections. Moreover, the outer housing 22 can include a window 110 (shown in FIG. 1) that allows a smoker (vaporer) to view the amount of liquid aerosol formulation remaining in the reservoir 14. Alternatively, the outer casing can be translucent. In addition, the reservoir 14 can be refillable.

In one embodiment, as shown in FIG. 2, the first section 70 includes the outer housing (or casing) 22 extending in a longitudinal direction. As shown in FIG. 2, the first section 70 can also include an inner tube (or chimney) 62 coaxially positioned within the outer housing 22. The inner tube 62 forms an air passage 21 therein.

A first (upstream) gasket (or seal) 20 is fitted about an upstream end portion 65 of the inner tube 62, while at the same time, an outer perimeter 67 of the first (upstream), gasket 20 provides a liquid-tight seal with an interior surface 97 of the outer housing 22. A second (downstream) gasket 10 is fitted with a downstream end portion 81 of the inner tube 62. A central orifice 90 in the second gasket 10 allows for passage of air through the second gasket 10. The second gasket 10 can further include one or more additional holes positioned at opposing edges of the second gasket 10 through which the wick 28 can extend into the reservoir 14. Preferably, the wick 28 extends the full length of the reservoir 14.

In this embodiment, the reservoir 14 is contained in an annulus between the inner tube 62 and the outer housing 22 and between the first gasket 20 and the second gasket 10. Moreover, the reservoir 14 extends longitudinally within the outer cylindrical housing 22 of the first section 70. Thus, the reservoir 14 at least partially surrounds the central air passage 21 in the embodiment shown in FIG. 2. Preferably, the reservoir 14 comprises a liquid aerosol formulation which is volatilized when heated by the heater 19. Also preferably, the reservoir 14 does not include a liquid storage (retention), distribution medium, such as a fibrous material.

In a preferred embodiment, the heater 19 comprises a wire coil which surrounds a portion of the wick 28. In that embodiment, preferably the wire is formed of an electrically resistive material, such as a nickel-chromium alloy. Preferably, the heater 19 is wrapped about a portion of the filamentary wick 28 and opposing ends 112, 112' of the filamentary wick 28 extend into the reservoir 14 so as to deliver the liquid aerosol formulation from the reservoir 14 to the heater 19. In this embodiment, the filamentary wick 28 can be substantially U-shaped.

Figure 3:
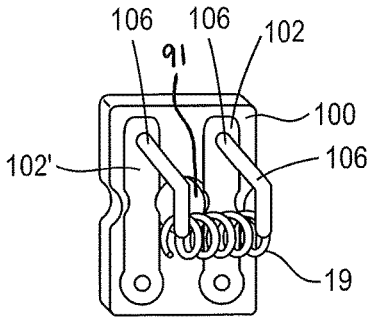
FIG. 3 is an enlarged view of a support plate for use in the electronic smoking article of FIG. 2.

Also in a preferred embodiment, the electronic smoking article 60 includes a support plate 100 operable to support the heater 19 and the wick 28 and to establish an electrical connection between the battery 12 and the heater 19. The support plate 100 is positioned transverse to the longitudinal direction of the electronic smoking article 60. A conductive circuit 102 is printed on a surface of the support plate as shown in FIG. 3. Electrical leads 26, 26' extend from a battery cathode connection and a central conductive post (anode) 104, which is the battery anode connection, through the reservoir 14 or through the air passage 21 (not shown) and to the printed, conductive circuit 102. Pins 106 extend from the printed, conductive circuit 102 and are connected to opposing ends of the heater 19 to form the electrical connection therewith via soldering, crimping or other suitable connections. In this embodiment, the support plate 100 is provided with an opening 91, which is aligned with the central orifice 90 of the downstream gasket 10.

Figure 4:
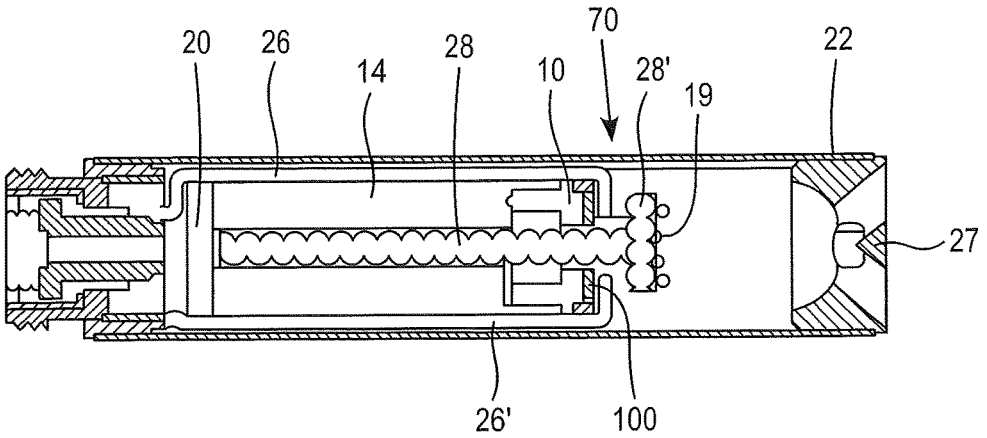
FIG. 4 is a truncated, cross-sectional view of a first section of an electronic smoking article according to a second embodiment.
Figure 5:
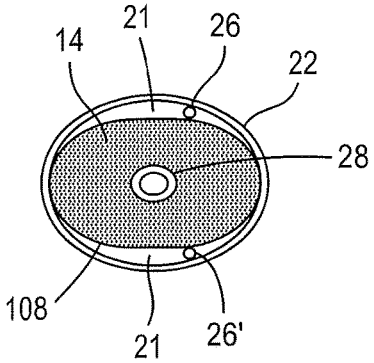
FIG. 5 is a cross-sectional view of the first section of the electronic smoking article of FIG. 4.

As shown in FIGS. 4 and 5, in a second embodiment, the first section can include a reservoir 14 having an outer wall 108 (FIG. 5) that is substantially oval in cross-section. In this embodiment, no inner tube (nor central air passage) is positioned within the reservoir 14. Instead, the air passage 21 is provided between the outer housing 22 and the outer wall 108 of the reservoir as shown in FIG. 5. Preferably, the electrical leads 26, 26' extend along the air passage 21, but can instead extend through the reservoir 14 as in other embodiments.

Moreover, as shown in FIG. 4, the second gasket 10 can include a single central orifice through which the filamentary wick 28 extends. A second wick 28' can be connected to an end of the filamentary wick 28 to form a substantially T-shaped wick structure. The heater 19 is wrapped about the second wick 28'.

Figure 6:
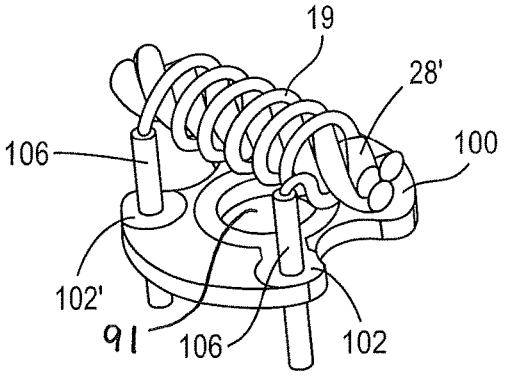
FIG. 6 is a perspective view of a support plate for use in the electronic smoking article of FIG. 5.

As with the embodiment of FIGS. 2 and 3, the support plate shown in FIGS. 4 and 6 supports the heater 19 and provides an electrical connection therewith. As shown in FIG. 6, the pins 106 are available for electrical connection with the leads 26, 26' and for electrical connections with the heater 19 via the printed circuit elements 102, 102' on the support plate 100. In this embodiment, the longitudinally extending wick 28 may be recited through the orifice 91 of the support plate 100.

Figure 7:
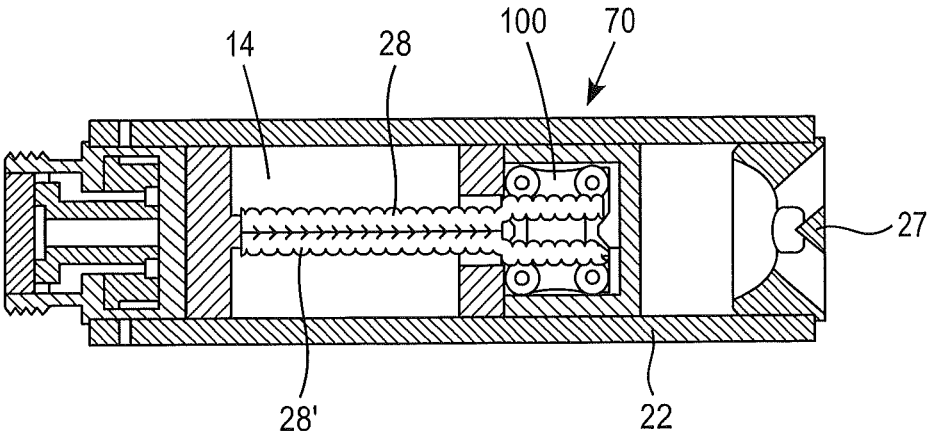
FIG. 7 is a truncated, cross-sectional view of a first section of an electronic smoking article according to a third embodiment.
Figure 8:
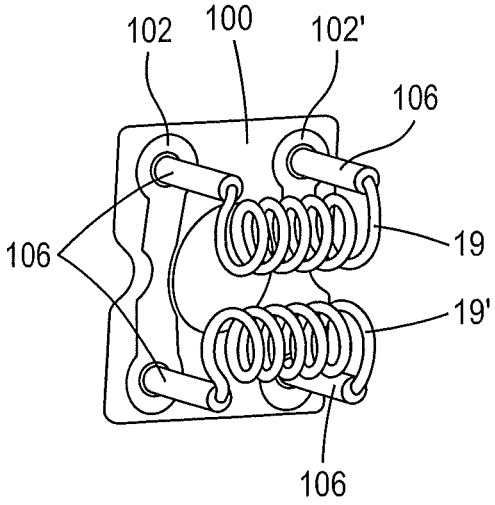
FIG. 8 is a perspective view of a support plate for use in the electronic smoking article of FIG. 7.

As shown in FIG. 7, the electronic smoking article 60 can include the reservoir as shown in FIG. 5. In addition, the electronic smoking article 60 can include a first wick 28 and a second wick 28'. As shown in FIG. 8, the first wick 28 can be associated with a first heater 19 and the second wick 28' can be associated with a second heater 19'. In this embodiment, the support plate 100 can extend longitudinally within the electronic smoking article 60.

The electronic smoking article 60 of each embodiment can also include at least one air inlet 40 operable (shown in FIGS. 1 and 2) to allow air to flow into the electronic smoking article 60 during smoking (vaping).

Moreover, each embodiment includes the power supply 12, which can be a battery that is operable to apply voltage across the heater 19. The battery can be a Lithium-ion battery or one of its variants, for example a Lithium-ion polymer battery. The power supply 12 may be rechargeable and can include circuitry allowing the battery to be chargeable by an external charging device.

The control circuitry 11 can be programmable and can include an application specific integrated circuit (ASIC). The control circuitry 11 can also include a heater activation light (or LED) 29 that is operable to glow when the heater 19 is activated.

As shown in FIGS. 2, 4 and 7, the electronic smoking article 60 of each embodiment described herein can further include the mouth-end insert 27 having at least two off-axis, preferably diverging outlets 21. Preferably, the mouth-end insert 27 includes at least two diverging outlets 21. (e.g. 3, 4, 5, or preferably 6 to 8 outlets or more). Preferably, the outlets 21 of the mouth-end insert 27 are located at ends of off-axis passages 23 and are angled outwardly in relation to the longitudinal direction of the electronic smoking article 60 (i.e., divergently). As used herein, the term "off-axis" denotes at an angle to the longitudinal direction of the electronic smoking article.

In a preferred embodiment, the electronic smoking article 60 is about the same size as a conventional smoking article. In some embodiments, the electronic smoking article 60 can be about 80 mm to about 110 mm long, preferably about 80 mm to about 100 mm long and about 7 mm to about 8 mm in diameter or greater. For example, in an embodiment, the electronic smoking article is about 84 mm long and has a diameter of about 7.8 mm.

The outer cylindrical housing 22 of the electronic smoking article 60 may be formed of any suitable material or combination of materials. Preferably, the outer cylindrical housing 22 is formed of metal and may be operative as part of the electrical circuit.

Preferably, the liquid aerosol formulation for use in each of the electronic smoking articles 60 described herein includes at least one aerosol former, optionally water, and flavors. The liquid aerosol formulation can include nicotine or be nicotine free. Moreover, the liquid aerosol formulation can include tobacco flavors or other suitable flavors.

It is contemplated that the heater 19 in each embodiment can be positioned upstream or downstream of the reservoir 14.

When the word "about" is used in this specification in connection with a numerical value, it is intended that the associated numerical value include a tolerance of ±10% around the stated numerical value. Moreover, when reference is made to percentages in this specification, it is intended that those percentages are based on weight, i.e., weight percentages.

Moreover, when the words "generally" and "substantially" are used in connection with geometric shapes, it is intended that precision of the geometric shape is not required but that latitude for the shape is within the scope of the disclosure. When used with geometric terms, the words "generally" and "substantially" are intended to encompass not only features which meet the strict definitions but also features which fairly approximate the strict definitions.

It will now be apparent that a new, improved, and non-obvious electronic smoking article has been described in this specification with sufficient particularity as to be understood by one of ordinary skill in the art. Moreover, it will be apparent to those skilled in the art that numerous modifications, variations, substitutions, and equivalents exist for features of the electronic smoking article which do not materially depart from the spirit and scope of the invention. Accordingly, it is expressly intended that all such modifications, variations, substitutions, and equivalents which fall within the spirit and scope of the invention as defined by the appended claims shall be embraced by the appended claims.

We claim:

1. An electronic article to produce a vapor, comprising:

a liquid formulation;

at least one filamentary wick operable to transfer the liquid formulation;

at least one heater operable upon a portion of the at least one filamentary wick to at least partially volatilize the liquid formulation and form the vapor;

a power supply operable to apply voltage across the at least one heater; and a support plate with a flat major surface operable to support the at least one heater and the at least one filamentary wick and to form an electrical connection between the at least one heater and the power supply, the flat major surface of the support plate being positioned to be transverse to a direction of air flow traveling through the electronic article while the electronic article is in operational use, and wherein the at least one filamentary wick includes a first wick and a second wick, the first wick including a first end extending into a reservoir, and the first wick including a second end penetrating through an orifice in the support plate and being connected to the second wick, the first wick and the second wick collectively being T-shape.

2. The electronic article of claim 1, wherein the flat major surface of the support plate includes a conductive circuit printed thereon.

3. The electronic article of claim 2, wherein at least two support pins extend from the conductive circuit on the flat major surface of the support plate, each of the at least two support pins being connected to opposing portions of the at least one heater.

4. The electronic article of claim 1, further comprising:

an outer wall with an oval cross-section at least partially defining the reservoir containing the liquid formulation.

5. The electronic article of claim 1, further comprising:

a mouth end insert on an end of the electronic article.

6. The electronic article of claim 1, wherein the at least one heater is a coil heater in communication with the at least one filamentary wick.

7. The electronic article of claim 4, wherein the at least one heater is near an end of the reservoir.

8. The electronic article of claim 1, further comprising:

an outer housing extending in a longitudinal direction.

9. The electronic article of claim 8, further comprising:

an inner tube within the outer housing, and wherein the reservoir is contained in an annulus between the inner tube and the outer housing.

10. The electronic article of claim 1, further comprising:

a first section attachable to a second section, wherein the at least one filamentary wick, the reservoir and the at least one heater are contained in the first section, and the power supply is contained in the second section.

11. The electronic article of claim 8, wherein the flat major surface of the support plate is about perpendicular to the longitudinal direction of the outer housing.

12. The electronic article of claim 3, further comprising:

electrical leads connecting the power supply to the conductive circuit.

13. The electronic article of claim 1, wherein the orifice is positioned directly upstream of the at least one heater and the portion of the at least one filamentary wick relative to the direction of air flow.

14. The electronic article of claim 1, wherein the support plate is upstream of the at least one heater relative to the direction of air flow.

* * * * *